US010779644B2

(12) United States Patent
Vanderwert et al.

(10) Patent No.: US 10,779,644 B2
(45) Date of Patent: Sep. 22, 2020

(54) ROTATING BOTTLE RACK

(71) Applicant: Dexter Vanderwert, Scarborough (AU)

(72) Inventors: Carly Vanderwert, Scarborough (AU); Dexter Vanderwert, Scarborough (AU)

(73) Assignee: Dexter Vanderwert, Scarborough (AU)

( * ) Notice: Subject to any disclaimer, the term of this patent is extended or adjusted under 35 U.S.C. 154(b) by 0 days.

(21) Appl. No.: 16/564,401

(22) Filed: Sep. 9, 2019

(65) Prior Publication Data

US 2020/0100586 A1 Apr. 2, 2020

(30) Foreign Application Priority Data

Sep. 9, 2018 (AU) ..... 2018903372

(51) Int. Cl.
*A47B 49/00* (2006.01)

(52) U.S. Cl.
CPC ..... *A47B 49/004* (2013.01)

(58) Field of Classification Search
CPC ..... A47F 5/04; A47F 5/02; A47F 5/01; A47F 5/05; A47F 5/10; A47F 7/28; A47F 7/00; A47F 5/0018; A47F 5/13; A47F 73/002; A47B 55/02; A47B 47/021; A47B 11/00; A47B 49/004; A47B 49/00
USPC .... 211/41.4, 90.3, 106, 74, 163, 133.4, 205, 211/131.1, 181.1, 133.2, 70, 144, 33, 37, 211/78, 112, 85.13, 126.9, 126.8; 108/139, 151, 59, 94; D7/704, 707; D6/677.2, 680.3, 681.3; 312/306, 312
See application file for complete search history.

(56) References Cited

U.S. PATENT DOCUMENTS 135,696 A * 2/1873 Dakin
197,931 A * 12/1877 Haight
258,442 A * 5/1882 Koser
931,961 A * 8/1909 Robinson
1,065,381 A * 6/1913 Martin ..... A47K 1/09 211/65
3,665,867 A * 5/1972 Carlson ..... A47B 31/02 108/25
4,026,417 A * 5/1977 Streim ..... A47F 5/02 211/163
4,030,608 A * 6/1977 Howard ..... A47F 5/02 211/131.1
4,036,367 A * 7/1977 Stambaugh ..... A47F 5/02 211/37
D251,046 S * 2/1979 Landwehr ..... D6/514
(Continued)

FOREIGN PATENT DOCUMENTS

DE 3344674 * 6/1985

*Primary Examiner* — Janet M Wilkens
(74) *Attorney, Agent, or Firm* — Sand, Sebolt & Wernow Co., LPA

(57) ABSTRACT

A rotatable wine display rack includes a base supporting a pole. Typically a plurality of shelves engages the pole separated by a spacer being a cylinder that has an upper and a lower flange. The upper flange is fixedly attached to the shelf above it and the bottom flange sits on top of the shelf underneath but disposed in between is a bearing. This allows shelves to be rotated independent of each other. Each shelf include a plurality of rods converging to the centre of the pole and so spaced that two roads support a bottle of wine. Attached to the top and adjustable in its position is a flat surface to ast as protection and/or a table for the rack.

13 Claims, 6 Drawing Sheets

(56) References Cited

U.S. PATENT DOCUMENTS

| | | | | |
|---|---|---|---|---|
| 5,277,488 | A * | 1/1994 | Cleary | F25D 25/027 211/131.1 |
| 6,296,335 | B1 * | 10/2001 | Compagnucci | A47B 49/004 108/23 |
| 6,502,707 | B1 * | 1/2003 | Sullivan | A47F 5/02 211/144 |
| 7,584,973 | B2 * | 9/2009 | Brager | B25H 3/026 108/141 |
| D627,611 | S * | 11/2010 | Cash | D6/677.2 |
| 8,985,351 | B1 * | 3/2015 | Longo | A47F 3/0404 211/13.1 |
| 9,615,660 | B2 | 4/2017 | Hogeback | |
| 2002/0074471 | A1 * | 6/2002 | Domenig | A47B 49/004 248/238 |
| 2011/0089128 | A1 * | 4/2011 | Jin | A01N 1/0242 211/163 |
| 2011/0100940 | A1 * | 5/2011 | Liao | A47B 87/0246 211/133.1 |
| 2016/0213143 | A1 * | 7/2016 | Hogeback | A47B 73/00 |

* cited by examiner

ROTATING BOTTLE RACK

CROSS REFERENCE TO RELATED APPLICATIONS

This application claims the benefit of Australian Provisional Application Serial Number 2018903372, filed on Sep. 9, 2018; the disclosure of which is incorporated herein by reference.

FIELD OF THE INVENTION

The present invention relates a rotating bottle rack especially one where the bottles are presented in such a way that the labels can be easily viewed.

BACKGROUND TO THE INVENTION

Most wine racks used in cellars and wine stores support the bottles along the length of the bottle within a grid of generally rectangular cavities stacked upon and next to each other, each rectangular cavity typically formed by pairs of parallel wood supports held in position by front and rear frame structures.

These wine racks are generally longitudinal and are solidly built wooden structures. The cavities are capable of storing one or more bottles of wine vertically stacked on top of each other.

The wine rack is typically configured such that a user places a bottle of wine longitudinally within one of the rectangular cavities. When the rack is full of wine bottles, only the top ends of the wine bottles are generally visible when viewing the wine rack—and the labels on the wine bottle are not generally visible by the user. Accordingly, viewing wine labels is often difficult. Many wine collectors and retailors desire to more fully display their wine bottles.

The racks further do not provide a flat surface to provide a platform to hold a selected bottle of wine or even glasses.

The object of this invention is to provide a wine display that overcomes at least some of the above mentioned problems or provides the public with a useful alternative.

SUMMARY OF THE INVENTION

In a first aspect the invention comprises a wine display rack comprising:

a base supporting a pole;

at least one shelf adapted to engage the pole through a central aperture;

the shelf including a plurality of rods extending inwardly and upwardly to the centre of the pole, so configured that two rods support a bottle of wine therein between;

the shelf including an outer wall whereby the rods are connected towards the bottom of the wall to provide a surface to engage the bottom of the bottle sitting on top of the rods.

In preference located above the shelf and attached, to the pole is a flat surface acting as a cover or a table for the rack.

Preferably the flat surface is adjustable in height with respect to the shelf.

In preference there are a plurality of shelves, each shelf separated by a cylinder engaging the pole, the cylinder including an upper flange fixedly connected to the shelf above and a lower flange sitting on top of the shelf below and wherein a bearing is located between the lower flange and the shelf below to enable for independent rotation of the shelves.

In preference the support rods are cylindrical in shape.

In preference the base includes a cover adapted to enclose the base.

Preferably each shelf is adapted to hold sixteen bottles of wine.

It should be noted that any one of the aspects mentioned above may include any of the features of any of the other aspects mentioned above and may include any of the features of any of the embodiments described below as appropriate.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF THE INVENTION

Figure 1:
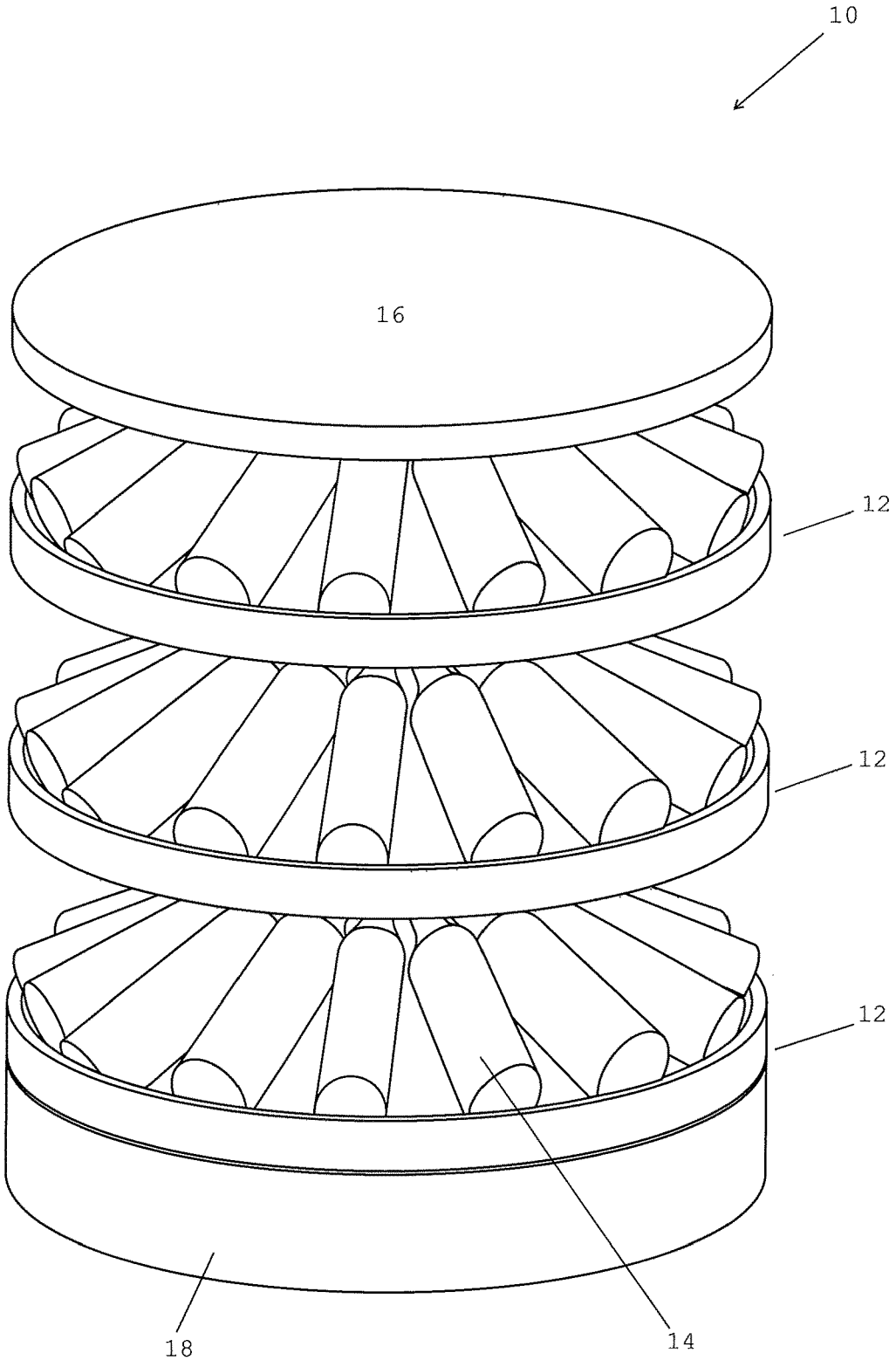
FIG. 1 is a schematic perspective view of a rotating wine display embodying the present invention.

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

Although the invention will now be described primarily in conjunction with a display system for holding wine bottles, it should be expressly understood that the invention may be applicable to other applications where it is desired to hold and display other bottled items. Indeed it may also be used to display any other items whether it is food or collectables.

Figure 2:
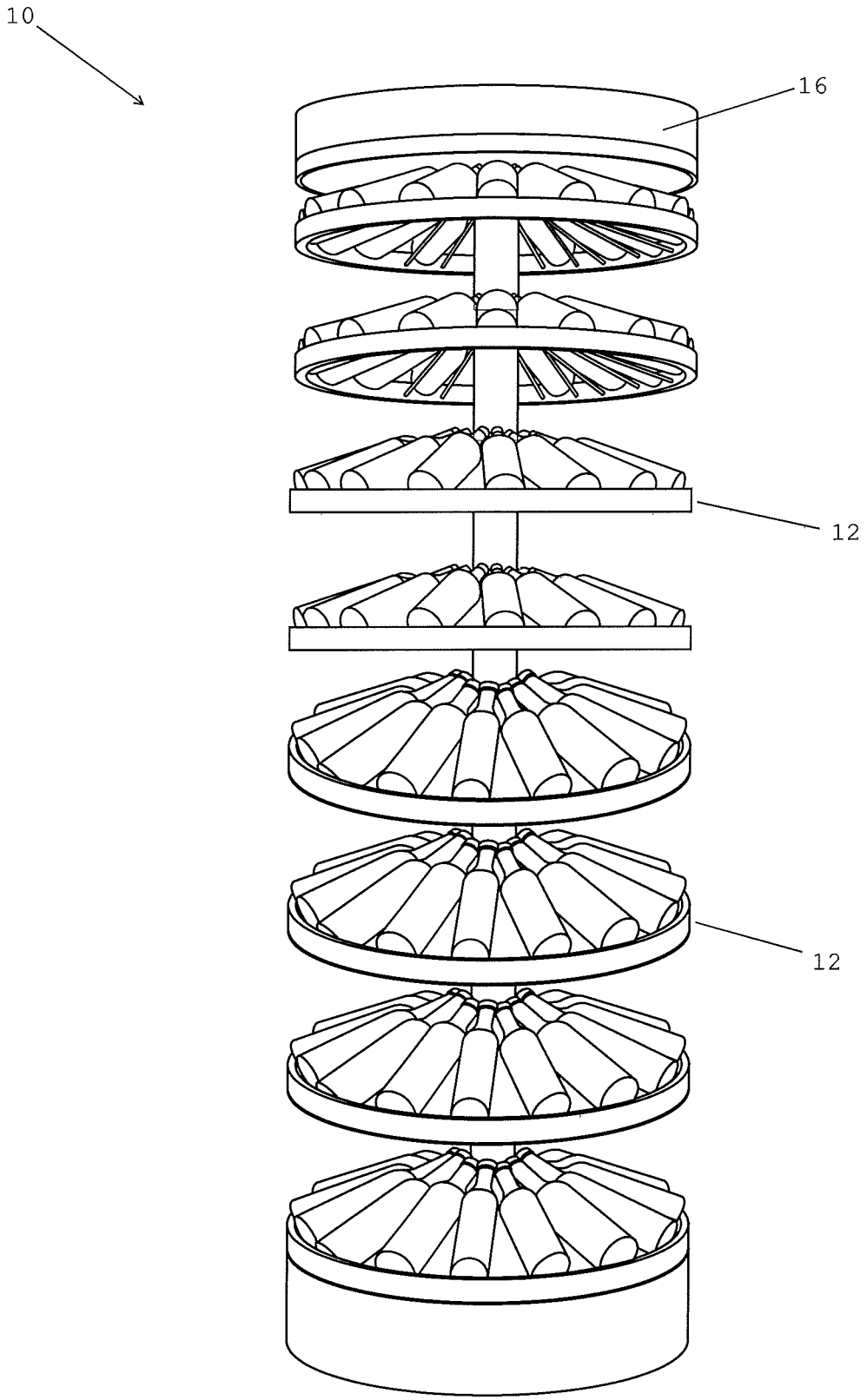
FIG. 2 is a schematic perspective view of a rotating wine display as in FIG. 1 but with more shelves.

The Figures illustrate a rotating bottle display 10, FIG. 1 illustrating a display with three shelves 12 and FIG. 2 with eight shelves 12. Each shelf is adapted to hold a number of bottles 14. On top of the display is a flat surface 16, the display supported also by base 18.

Figure 3:
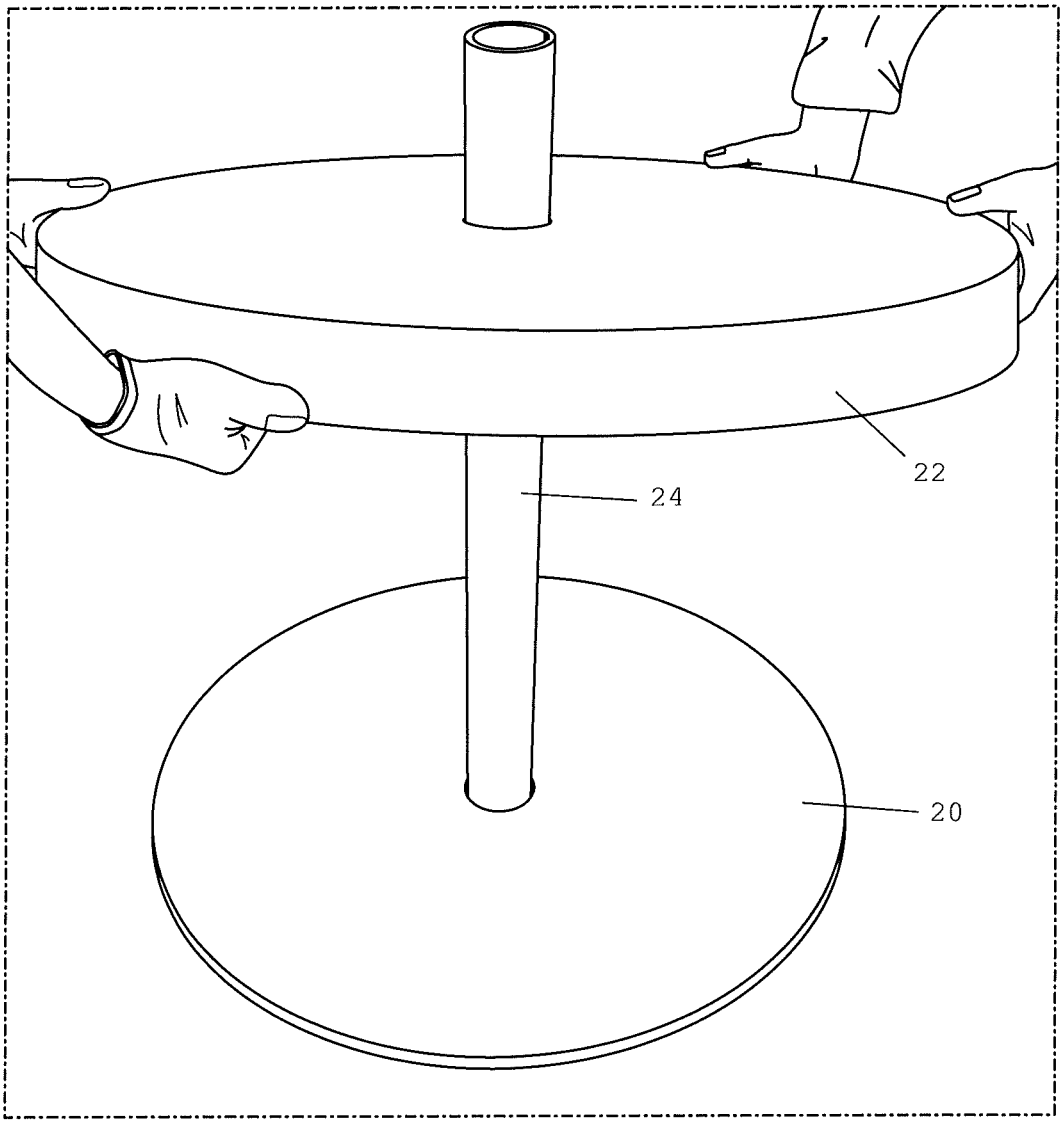
FIG. 3 is a partial view of the rotating wine display illustrating the construction of the base.

Referring to FIG. 3 the base includes metal plate 20 enclosed by and covered by a cover 22 typically made of wood having an internal cavity. Extending centrally and vertically from the plate and through the cover 22 is a pole 24. These are all attached appropriately to each other using well known means such as screws. The base is designed carefully for stability so as to withstand the weight of the bottles displayed.

Figure 4:
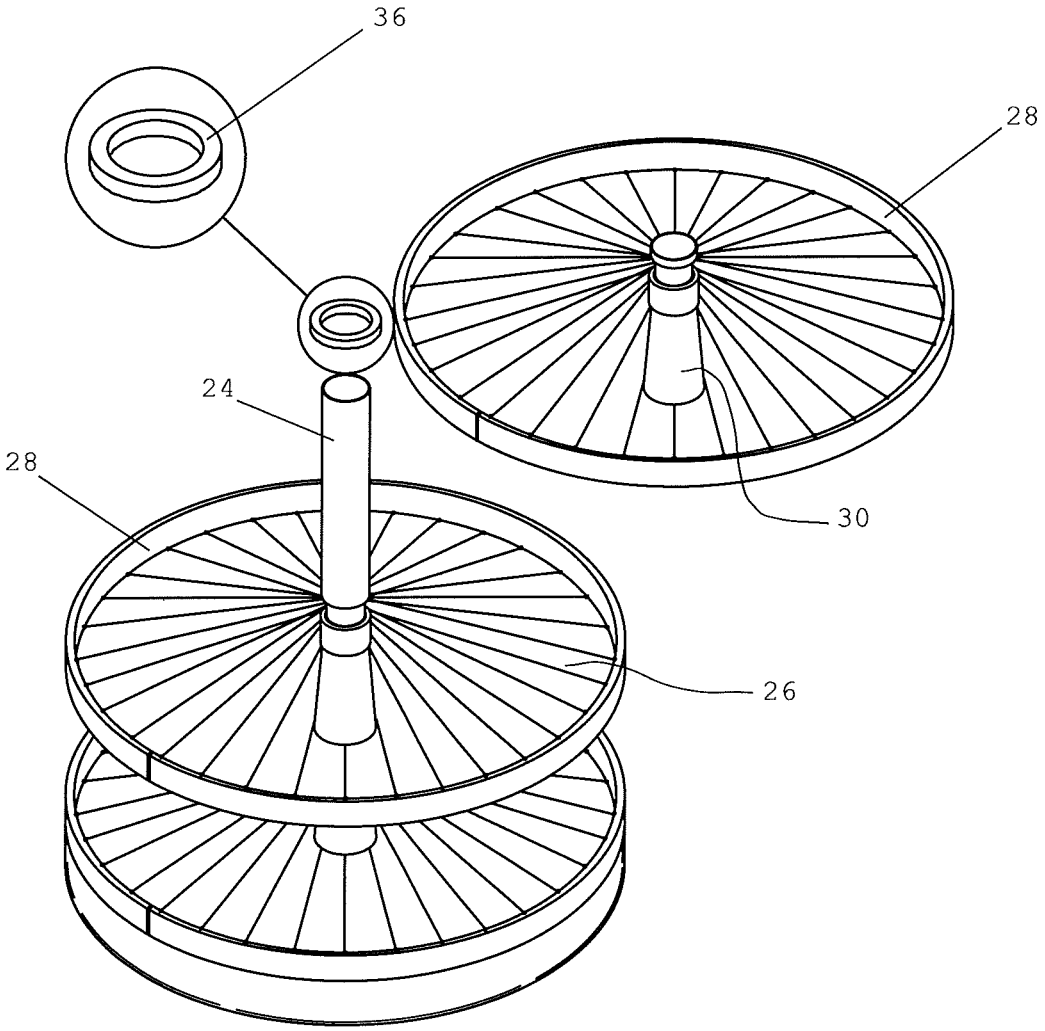
FIG. 4 illustrates the addition of the shelves to the base of FIG. 3.
Figure 5:
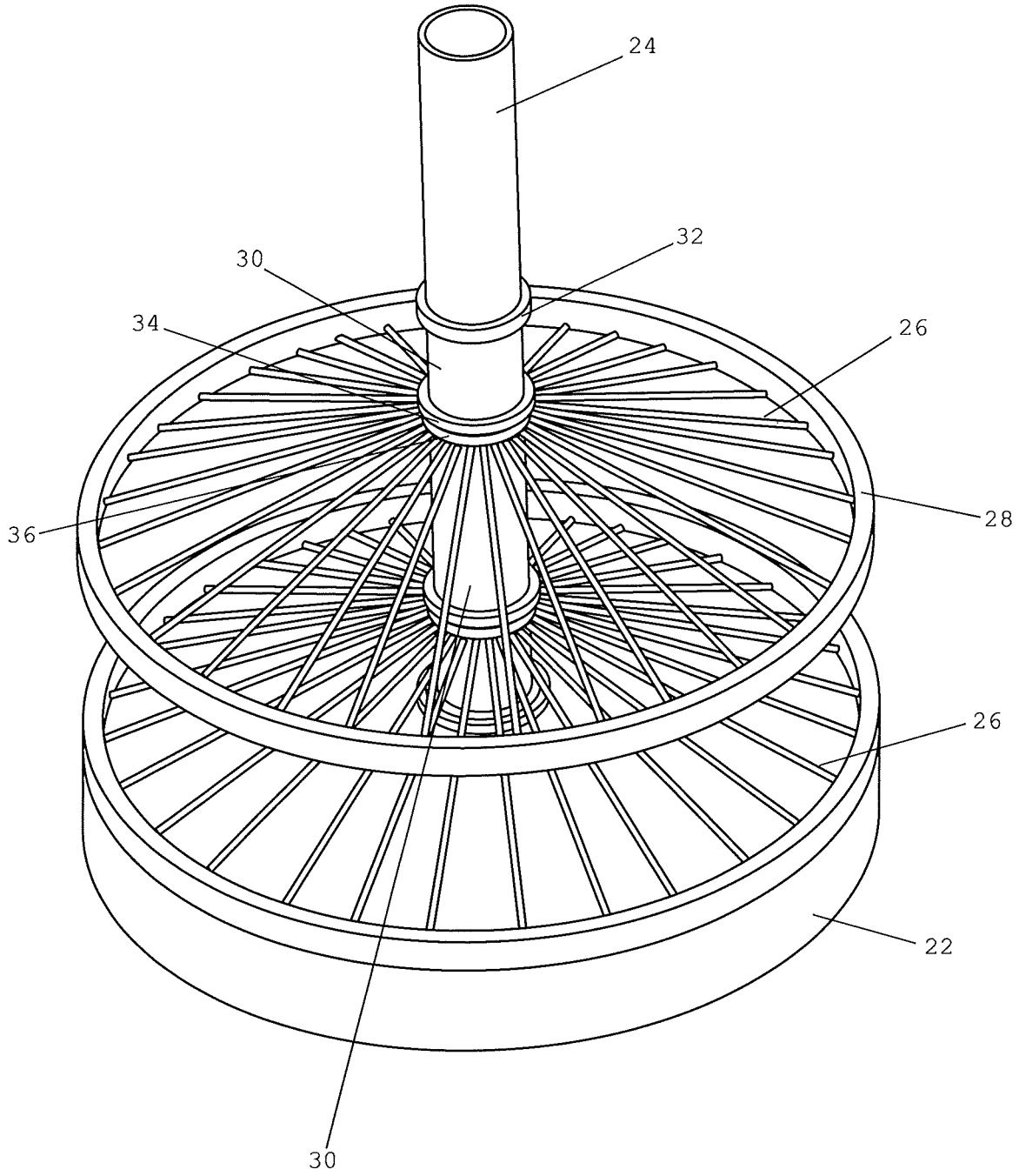
FIG. 5 illustrates further construction of the rotating wine display.
Figure 6:
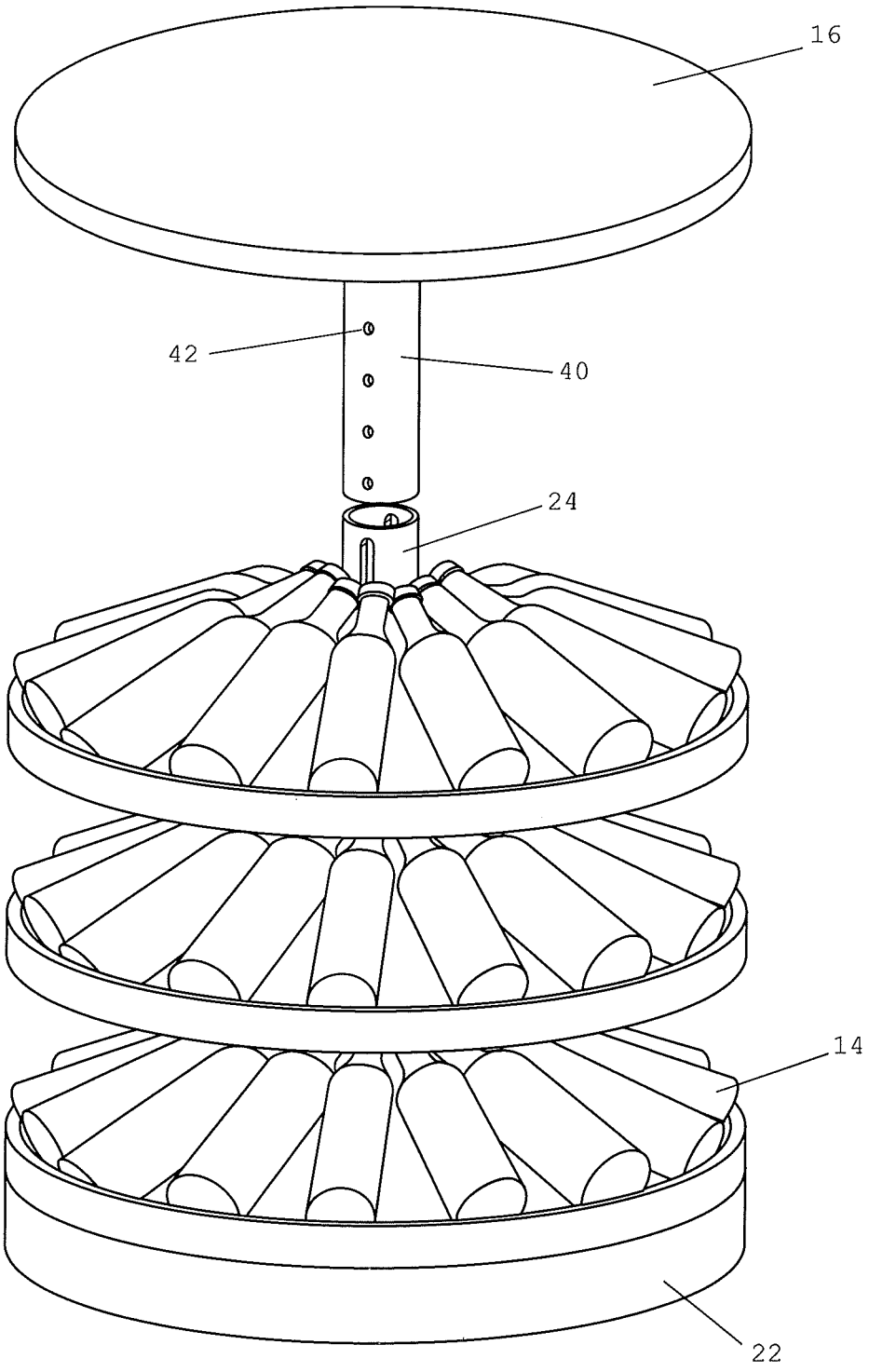
FIG. 6 illustrates the addition of the top flat surface.

Referring to FIGS. 4 and 5 shelves 12 include rods 26 converging towards the pole 24 from an outside circumferential wall 28. The rods are attached to the wall at its lower end and extend upwardly so that the bottle is at an upward angle allowing for the display of the label. The bottles are held in place from slipping down by the wall 28 whereby the bottom of the bottle partially engages the wall 28. Typically there are sufficient rods so that two rods support a bottle with there being a gap between the bottles when arranged on the display.

A cylinder (spacer) 30 is of a sufficient diameter to be inserted onto the pole and includes and upper flange 32 and a lower flange 34. A shelf is fixedly attached to the upper flange 32 using screws for example, and located on top of the shelf is a bearing 36 sitting on top of the lower flange. This enables a shelf to rotate, rotating the cylinder below it that rotates freely because of the bearing located on the shelf below. The cylinder may come in multi-parts if required. Thus each shelf can rotate independent of the other.

To maintain the correct positioning of the bottles, each pair of rods extends radially outward from the post 24 to the wall 28.

Once the desired number of shelves has so been assembled a flat surface 38 including a downward cylinder 40 engages the post 24 by typically sliding over the post, although it could engage the inside of the post. The cylinder can have multiple apertures 42 that fixedly engage the post so as to vary the height of the surface 16 to the rest of the shelves. It can thus act as a table especially where there are not too many shelves for a person to put their glasses or bottle of wine on top.

The reader will now appreciate the present invention which provides a rotating shelving system whereby the shelves are all supported on a central pole and can rotate freely. The shelves are not locked to the pole—rather they are supported by cylinders located between the shelves and each shelf including an individual bearing. Whilst the embodiment above teaches that each shelf is attached to a cylinder below it may also be attached to a cylinder above it and it is not intended that this mechanical configuration be the only one.

The display can be made from metal, MDF wood as well as other materials such as glass, acrylic, poly carbonate and other wood materials.

LIST OF COMPONENTS

The drawings include the following integers.

10 bottle display
12 shelves
14 bottles
16 flat surface
18 base
20 metal plate
22 cover
24 pole
26 rods
28 circumferential wall
30 cylinder
32 upper flange
34 lower flange
36 bearing
40 downward cylinder
42 apertures Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A wine display rack comprising:

a base supporting a pole;

a plurality of shelves engaging the pole through a central aperture;

the plurality of shelves including a plurality of rods extending inwardly and upwardly to a centre of the pole, so configured that two rods support a bottle of wine thereinbetween;

each shelf of the plurality of shelves including an outer wall whereby the plurality of rods are connected towards a bottom of the outer wall to provide a surface to engage a bottom of the bottle of wine sitting on top of the two rods; and wherein each shelf is separated by a cylinder engaging the pole, the cylinder including an upper flange fixedly connected to the shelf above and a lower flange sitting on top of the shelf below and wherein a bearing is located between the lower flange and the shelf below to enable for independent rotation of the plurality of shelves.

2. The wine display rack as in claim 1, wherein a flat surface is located above an upper shelf and attached to the pole, and the flat surface acts as a cover or a table for the wine display rack.

3. The wine display rack as in claim 2, wherein the flat surface is adjustable in height with respect to the upper shelf.

4. The wine display rack of claim 1, wherein each of the plurality of rods is cylindrical in shape.

5. The wine display rack of claim 1, wherein the base includes a cover adapted to enclose the base.

6. The wine display rack of claim 1, wherein each shelf of the plurality shelves is adapted to hold sixteen bottles of wine.

7. A wine display rack comprising:

a base supporting a pole;

at least two shelves adapted to engage the pole through a central aperture in a vertical arrangement defining an upper shelf and a lower shelf, wherein the at least two shelves include a plurality of rods extending inwardly and upwardly to the centre of the pole, so configured that two rods support a bottle of wine thereinbetween;

wherein the at least two shelves include an outer wall whereby the plurality of rods is connected towards a bottom of the outer wall to provide a surface to engage a bottom of the bottle of wine sitting on top of the two rods; and wherein the at least two shelves are separated by a cylinder engaging the pole, the upper shelf being fixedly attached to the cylinder, and wherein the cylinder engages the lower shelf to provide support for the upper shelf; and wherein the cylinder includes an upper flange fixedly connected to the upper shelf and a lower flange sitting on top of the lower shelf.

8. The wine display rack as in claim 7, wherein located above the upper shelf and attached to the pole is a flat surface acting as a cover or a table for the wine display rack.

9. The wine display rack as in claim 8 wherein the flat surface is adjustable in height with respect to the upper shelf.

10. The wine display rack of claim 7, wherein each of the plurality of rods is cylindrical in shape.

11. The wine display rack of claim 7, wherein the base includes a cover adapted to enclose the base.

12. The wine display rack of claim 7, wherein each shelf of the at least two shelves is adapted to hold sixteen bottles of wine.

13. The wine display rack of claim 7, wherein the upper shelf and lower shelf are independently rotatable about the pole.

* * * * *